United States Patent [19]

Tanaka et al.

[11] Patent Number: 4,740,405

[45] Date of Patent: Apr. 26, 1988

[54] EXTRUDED FRAME MEMBER

[75] Inventors: Makoto Tanaka; Masato Fujii, both of Fukui, Japan

[73] Assignee: Fukubi Kagaku Kogyo Kabushiki Kaisha, Japan

[21] Appl. No.: 302

[22] Filed: Jan. 5, 1987

[51] Int. Cl.[4] ..... E06B 1/28

[52] U.S. Cl. ..... 428/45; 49/504; 49/DIG. 2; 52/309.16; 428/76; 428/542.8

[58] Field of Search ..... 49/DIG. 2, 504; 52/309.16; 428/45, 76, 542.8

[56] References Cited

U.S. PATENT DOCUMENTS

| | | | |
|---|---|---|---|
| 4,040,219 | 8/1977 | Budich | 52/732 X |
| 4,420,920 | 12/1983 | Hewitt | 428/76 X |
| 4,430,370 | 2/1984 | Gallagher | 428/542.8 X |
| 4,492,063 | 1/1985 | Schock et al. | 49/DIG. 2 |
| 4,514,449 | 4/1985 | Budich et al. | 428/76 |
| 4,556,594 | 12/1985 | Sedlatschek et al. | 428/542.8 X |

*Primary Examiner*—Henry F. Epstein

*Attorney, Agent, or Firm*—Kane, Dalsimer, Sullivan, Kurucz, Levy, Eisele and Richard

[57] ABSTRACT

An extruded frame member includes an elongated molded body of a one-piece construction having at least one elongated sheet-like wall having at least one elongated projection formed on one side of the wall and extending longitudinally of the molded body. A reinforcing wire is embedded in and extends along the elongated projection. The molded body is made of a thermoplastic resin. The reinforcing wire includes a bundle of fibers joined together by a thermosetting resin impregnated in the fiber bundle. The fibers have a higher melting point than the thermoplastic resin.

4 Claims, 3 Drawing Sheets

EXTRUDED FRAME MEMBER

BACKGROUND OF THE INVENTION

1. Field of the Invention

This invention relates to an extruded frame member for forming a frame such as a sash.

2. Prior Art

One conventional molded frame material, as disclosed in Japanese Patent Application Laid-Open (Kokai) No. 57-197385 comprises a molded body having sheet-like walls and a plurality of reinforcing elements either embedded in or fused to the sheet-like walls, the reinforcing element being composed of a bundle of fibers joined together by a thermoplastic resin. This molded frame member is produced by extrusion. For forming a frame such as a sash, using a plurality of frame members, obliquely-cut ends of the frame members are butt-jointed by hot plate welding or fusing. During this butt-jointing, the ends of the frame members which are heated and softened are pressed against each other, and at this time the ends of the reinforcing fiber bundles are also pressed against each other, so that these ends are caused to be bent or deformed since the thermoplastic resin binding the fibers are softened. As a result, the reinforcing fiber bundles will not appear at a line of joint between the two frame members even after a welding or fusing bead formed along the joint line is removed.

However, the above conventional frame member has the following disadvantages:

(i) First, when extruding the frame member, the thermoplastic resin binding the fibers of the reinforcing element together becomes soft, so that the fiber bundle tends to become loose. Particularly, in the case where the reinforcing fiber bundle is embedded in the wall of the molded body, the embedded reinforcing fiber bundle can not be accurately positioned relative to the wall. Incidentally, it is considered that the main reason why the thermoplastic resin is used to bind the reinforcing fibers together is that the ends of the two reinforcing fiber bundles, when pressed against each other, can be easily bent or deformed because of the softening of the thermoplastic resin binding the fibers, thereby preventing the reinforcing fibers from appearing at the butt-joint of the two frame members.

(ii) Secondly, when the two frame members are butt-jointed together by hot plate fusing, the deformation of the ends of the reinforcing fiber bundles pressed against each other occurs together with the deformation of their respective molded bodies of a thermoplastic resin. And, since the reinforcing fibers and the molded body are different in deformation behavior from each other, it is rather difficult to fuse the two frame members uniformly along a line of the butt-joint. Particularly, in the case where the reinforcing fiber bundle is embedded in the wall of the molded body, extreme care must be exercised to prevent an outer surface of the wall, exposed to an external view, from being deformed during the fusing. In addition, since the butt-jointed reinforcing fibers are not fused together, the area of fusing or bonding is reduced by an amount corresponding to the cross-sectional area of the reinforcing fiber bundles. Therefore, to compensate for this, it is necessary to increase the thickness of the wall of the molded body.

(iii) Thirdly, if the wall of the molded body in which the reinforcing fiber wire is embedded is relatively thin, a stripe appears on the outer surface of the wall, exposed to an external view, along the embedded reinforcing fiber bundles due to the uneven flow of the resin. This detracts much from the appearance of the resultant frame. On the other hand, if the thickness of the wall is increased to overcome such a difficulty, this requires added material and is uneconomical.

SUMMARY OF THE INVENTION

It is therefore an object of this invention to provide an extruded frame member of a thermoplastic resin which has a high rigidity, a dimensional stability and a stable moldability, and can achieve, when butt-jointed by fusing, a uniform fusing and a high bonding strength According to the present invention, there is provided an extruded frame member comprises an elongated molded body of a one-piece construction having at least one elongated sheetlike wall having at least one elongated projection formed on one side of the wall and extending longitudinally of the molded body, and a reinforcing wire embedded in and extending along the elongated projection, the molded body being made of a thermoplastic resin, the reinforcing wire comprising a bundle of fibers joined together by a thermosetting resin impregnated in the fiber bundle, and the fibers having a higher melting point than the thermoplastic resin.

DESCRIPTION OF THE PREFERRED EMBODIMENT OF THE INVENTION

Figure 1:
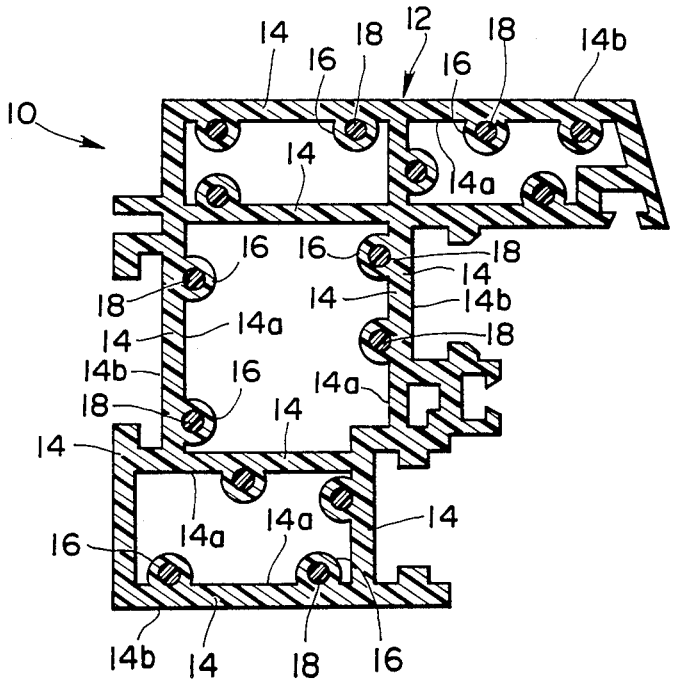
FIG. 1 is a cross-sectional view of an extruded frame member provided in accordance with the present invention.

A molded frame member 10 for forming a sash or window frame according to one embodiment of this invention is shown in FIG. 1. The frame member 10 comprises a hollow elongated body 12 of a one-piece molded construction defined by a plurality of sheet-like walls 14. The walls 14 includes three inner partition walls which divide the interior of the hollow body 12 into four sections of a generally square shape. The molded body 12 is made of a thermoplastic resin such as polyvinyl chloride and polyethylene. The molded body 12 may be made of high density thermoplastic foam.

Each of the walls 14 of the molded body 12 has one or more elongated projections or ribs 16 formed integrally on one surface or side **14*a* thereof and extending along the length of the molded body 12, and a reinforcing wire 18 is embedded in the elongated projection 16. Those walls 14 other than the inner partition walls 14, that is, the outer walls 14 defining an outer shape or appearance of the molded body 12, have their respective elongated projections 16 on the inner surfaces 14*a* thereof. Each of the elongated projections 16 has a uniform cross-section throughout the entire length thereof. In the illustrated embodiment, each elongated projection 16** has a semi-circular cross-section, but it may have any other cross-sectional shape.

Each of the reinforcing wires 18 comprises a bundle of fibers, such as glass fiber roving, joined together by a thermosetting resin such as a modified epoxy resin. The fibers constituting the reinforcing wire 18 has a higher melting point than the thermoplastic resin of which the molded body 12 is made. For producing the reinforcing wire 18, a bundle of fibers are first impregnated, for example, with a modified epoxy resin liquid, and the fiber bundle so impregnated is heated to set or cure the resin to bind the fibers together to form the reinforcing wires 18.

The frame member 10 of the above construction is molded by extrusion, and the reinforcing wires 18 are embedded in their respective elongated projections 16 by this extrusion operation. Thus, the reinforcing wires 18 are molded in the frame body 12 when the frame body 12 is extruded. The reinforcing wires 18 serve to reinforce the molded frame body 12 efficiently and to maintain the dimensional stability of the frame member 10, that is, prevent a deformation of the frame member 10.

Figure 2:
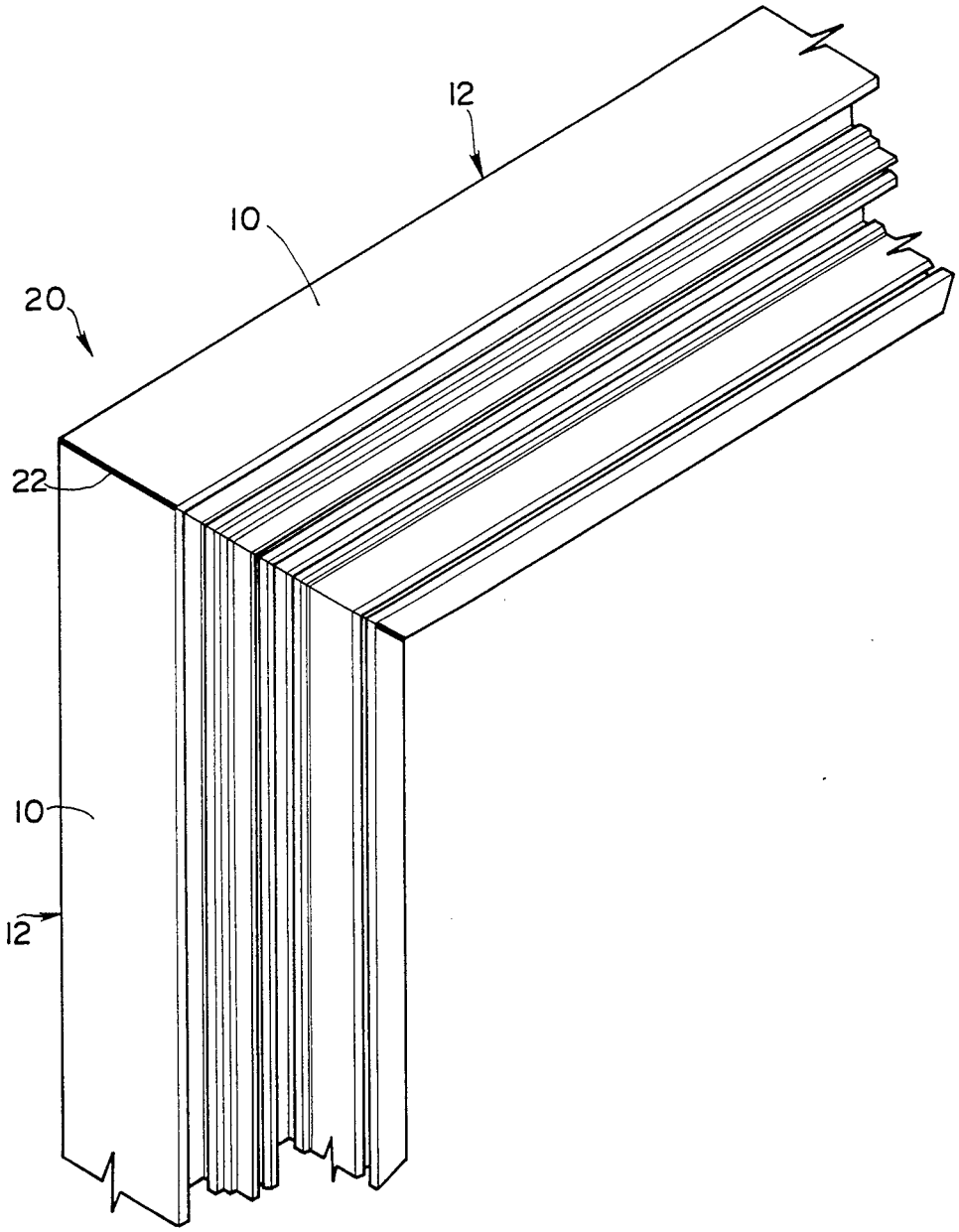
FIG. 2 is a perspective view of a portion of a sash, showing two frame members butt-jointed together by fusing.
Figure 3:
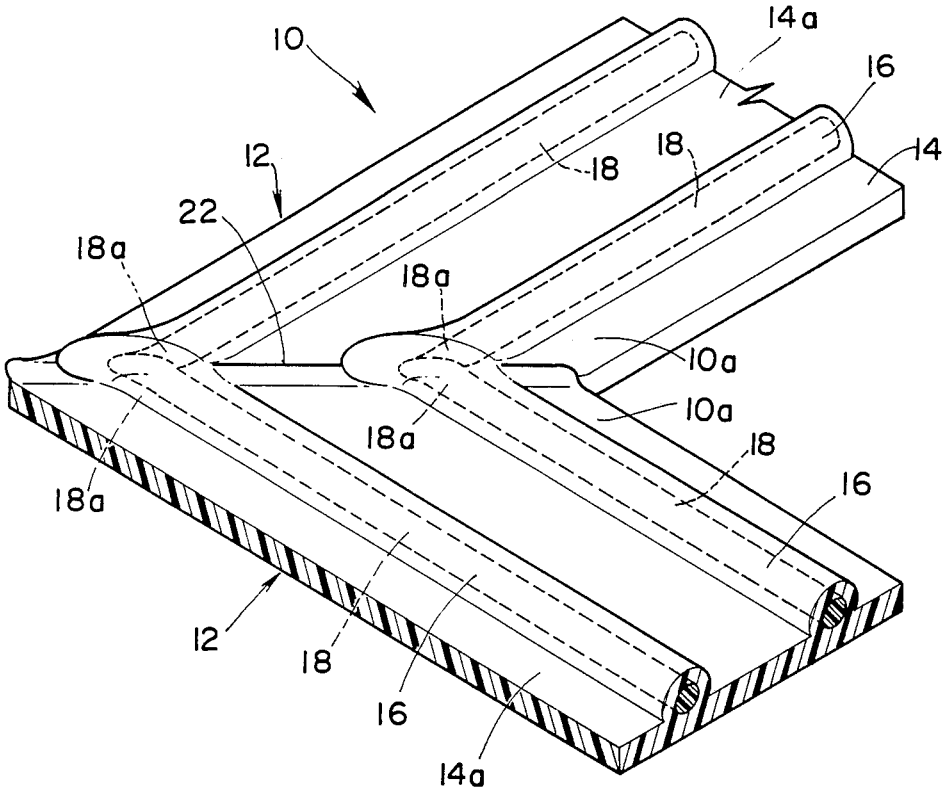
FIG. 3 is a fragmentary perspective view of the sash, showing a inside of the sash.

FIG. 2 shows a portion of a sash 20 formed using the frame members 10. Four frame members 10 are joined together end-to-end to form the sash of a square shape. More specifically, the opposite ends of each of the four frame members 10 are cut obliquely, for example, at an angle of 45°. Then, one ends 10*a* of two frame members 10 are heated by a hot plate to a temperature enough to render their respective molded bodies 12 of a thermoplastic resin soft, and then the one ends 10*a* of the two frame members 10 are pressed against each other, so that the molded bodies 12 are fused together at their one ends, thereby firmly joining the two frame members 10 together along a joint line 22 (FIG. 2). At this time, each of the elongated projections 16 of one frame member 10 is fused end-to-end to a respective one of the mating elongated projections 16 of the other frame member 10, as shown in FIG. 3. At this time, when the softened ends of the mating projections 16 are pressed against each other, the mating reinforcing wires 18 embedded in the respective elongated projections 16 are also pressed against each other end-to-end, so that the abutted ends 18*a* of the reinforcing wires 18 are slightly deformed or bent. Since each elongated projection 16 projects from the respective wall 14, the softened ends of the mating projections 16, when pressed against each other, can be easily bent or deformed regardless of a deformation of the abutted wall ends, so that the abutted ends 10*a* of the two frame members 10 are fused together uniformly along the entire length of the joint line 20, thereby joining the frame members 10 with a high bonding strength. Specifically, the abutted ends 18*a* of the reinforcing wires 18 can be easily bent or deformed as the abutted projections 16 are deformed or bent, and therefore the surface 14*b* of each wall 14 facing away from the other surface 14*a* on which the projection or projections 16 are formed is hardly subjected to deformation. Thus, no appreciable deformation appears on the overall outer surface of the frame member 10. The other frame members 10 are butt-jointed sequentially to the above frame members 10 in the same manner to provide the sash 20.

Since the fiber bundle of the reinforcing wire 18 is bound firmly by the thermosetting resin, the reinforcing wire 18 is maintained in its original shape when the frame member 10 is molded by extrusion. Therefore, each reinforcing wire 8 is molded in place in the molded body 12, thereby rendering the molding of the frame member 10 easier. Further, even in the case where the walls 14 of the molded body 12 are relatively thin, the walls 14 of the frame members 10 are fused together with a sufficient bonding strength since the elongated projections 16 are formed on one surface 14*a* of the wall 14. Therefore, in comparison with the above-mentioned conventional frame member of the type in which the reinforcing fibers are embedded in the walls, the walls 14 of the molded body 12 can be reduced in thickness while maintaining the same rigidity of this conventional frame member. In addition, any stripes and other marks will not appear on the outer surface of the frame member 10.

While the frame member according to the present invention has been specifically shown and described herein, the invention itself is not to be restricted to the exact showing of the drawings or the description thereof. For example, although each reinforcing wire 18 is completely embedded in a respective one of the elongated projections 16, it may be partly embedded in the projections 16. Also, although the surface of each wall 14 on which the elongated projection 16 is formed is flat, this surface may be curved or convex.

What is claimed is:

1. An extruded frame member comprises an elongated molded body of a one-piece construction having at least one elongated sheet-like wall having at least one elongated projection formed on one side of said wall and extending longitudinally of said molded body, and a reinforcing wire embedded in and extending along said elongated projection, said molded body being made of a thermoplastic resin, said reinforcing wire comprising a bundle of fibers joined together by a thermosetting resin impregnated in said fiber bundle, and said fibers having a higher melting point than said thermoplastic resin.

2. An extruded frame member according to claim 1, in which said molded body is of a hollow construction having a plurality of said walls joined together to define an outer shape of said molded body, one or more of said elongated projections being formed on an inner surface of a respective one of said walls.

3. An extruded frame member according to claim 1, in which said fibers are glass fibers.

4. An extruded frame member according to claim 1, in which said thermoplastic resin is high density thermoplastic foam.

* * * * *